United States Patent [19]

Frei

[11] Patent Number: 4,705,258

[45] Date of Patent: Nov. 10, 1987

[54] SHEATHING FOR POURING A CONTAINER FABRICATED FROM CONCRETE

[75] Inventor: Peter Frei, Widnau, Fed. Rep. of Germany

[73] Assignee: Frei & Egger AG, Au/Schweiz, Switzerland

[21] Appl. No.: 760,676

[22] Filed: Jul. 30, 1985

[30] Foreign Application Priority Data

Jul. 30, 1984 [DE] Fed. Rep. of Germany ..... 3428036
Nov. 16, 1984 [DE] Fed. Rep. of Germany ..... 8433597

[51] Int. Cl.[4] ..... E04G 9/08

[52] U.S. Cl. ..... 249/27; 249/152; 249/159; 249/170; 249/180; 249/185; 249/194

[58] Field of Search ..... 249/20, 152, 155, 159, 249/170, 171, 178, 180, 181, 185, 192, 194, 11, 27; 264/32

[56] References Cited

U.S. PATENT DOCUMENTS

| | | | |
|---|---|---|---|
| 621,977 | 3/1899 | Sanford | 249/180 |
| 962,560 | 6/1910 | Farrar | 249/159 |
| 1,229,163 | 6/1917 | Stieler | 249/159 |
| 2,020,520 | 11/1935 | Sarosdy | 249/11 |
| 2,053,814 | 9/1936 | Carlson | 249/11 |
| 3,006,054 | 10/1961 | Dennis | 264/32 |
| 4,447,035 | 5/1984 | Ivey et al. | 249/180 |

FOREIGN PATENT DOCUMENTS

| | | | |
|---|---|---|---|
| 18878 | 11/1935 | Australia | 249/181 |
| 574553 | 4/1976 | Switzerland | 249/194 |

*Primary Examiner*—Jay H. Woo
*Assistant Examiner*—James C. Housel
*Attorney, Agent, or Firm*—Bachman & LaPointe

[57] ABSTRACT

An improved sheathing for use as a covering on a polygonal container having a plurality of adjustable support members for supporting the sheathing thereon. The sheathing comprises at least two adjacent pivotally connected panels having a vertical joint therebetween formed by an offset edge of one panel overlying an adjacent edge of the other panel. The panels include a mechanism for adjusting the angle between the panels comprising a pair of pivotally connected plates, each of the plates being pivotally connected to a respective one of the panels, and an adjusting screw threadedly mounted to the plates and extending towards the joint.

19 Claims, 20 Drawing Figures

Figure 1:
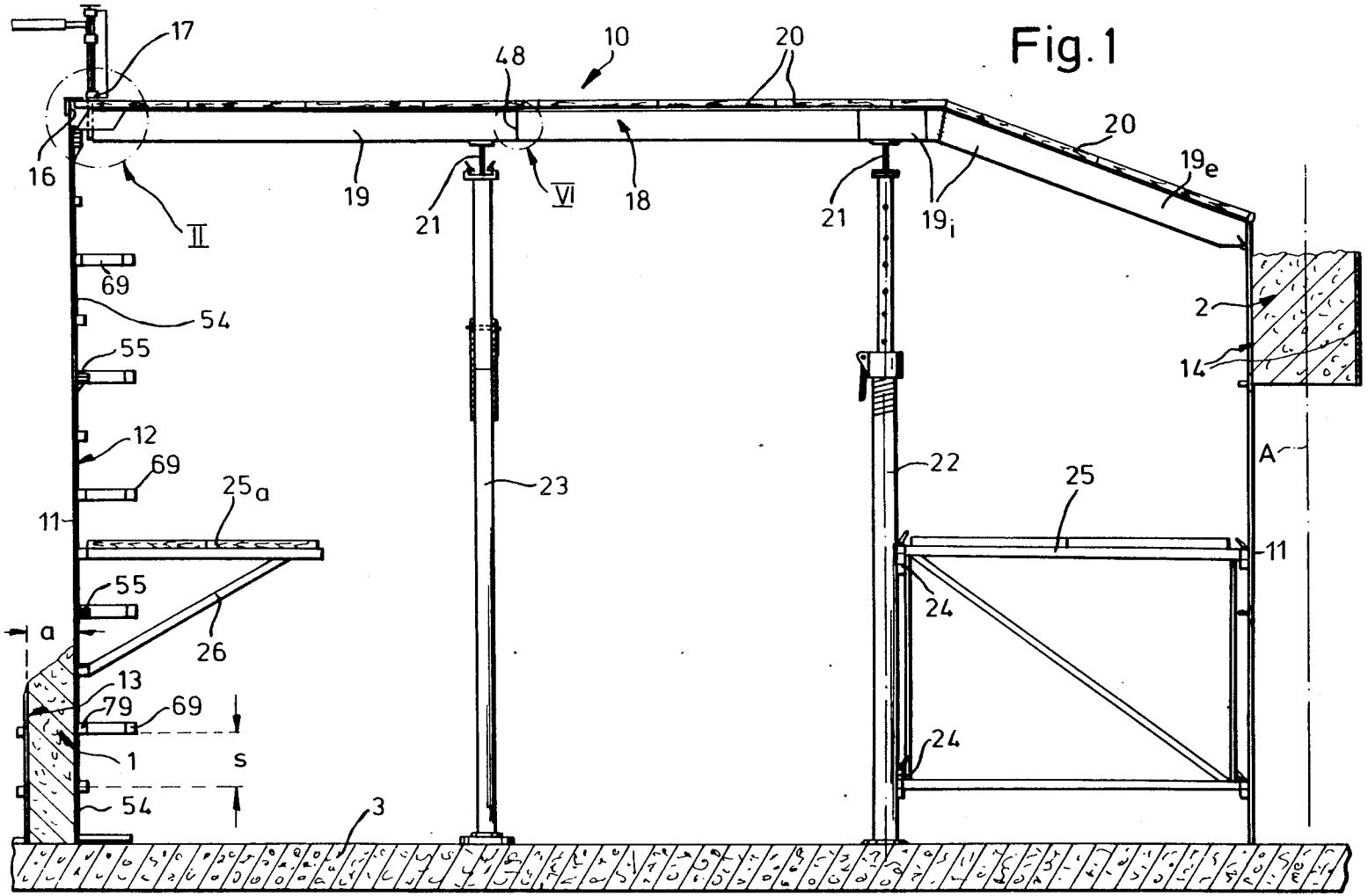

A
11
2
14
19e
20
25
19i
22
24
24
21
20
10
18
VI
48
23
21
19
3
25a
26
s
17
II
54
69
55
12
69
55
13
79
69
1
54
16
11
a 11
12
13
54
56
58
59
61
62
63
64
65
66
66a
67
68
70
71
72
73
74
80
81
82
m
t
w

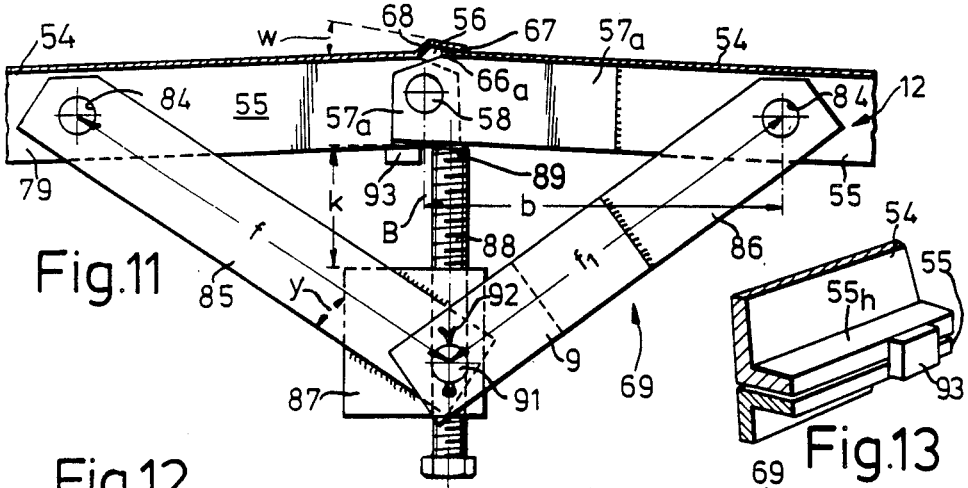
Fig.11
Fig.13
Fig.12
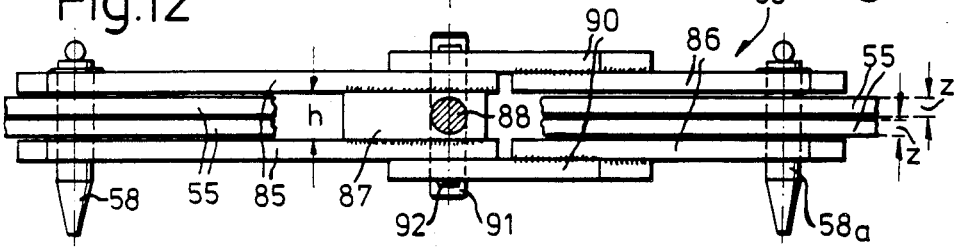
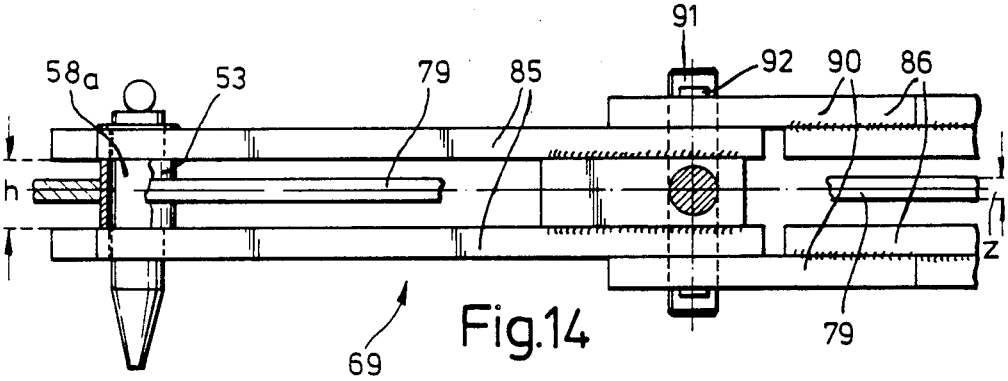
Fig.14
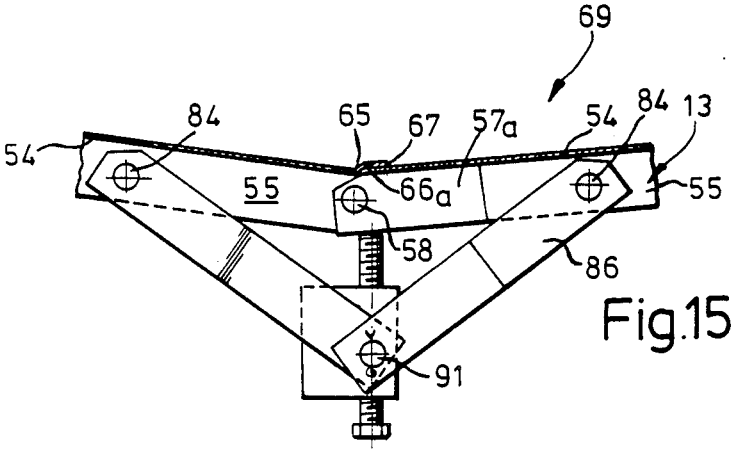
Fig.15

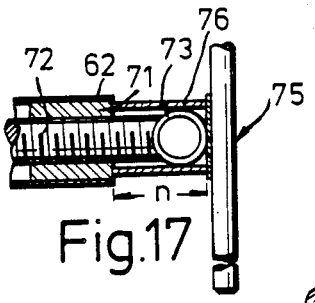
Fig.17
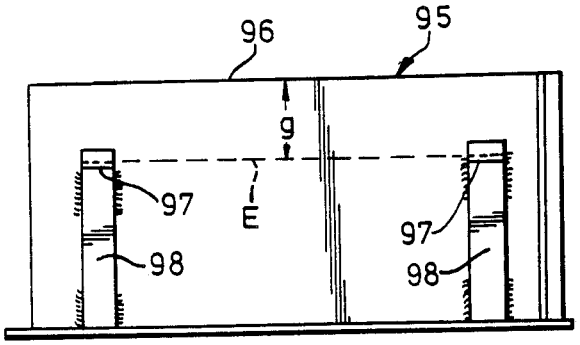
Fig.18
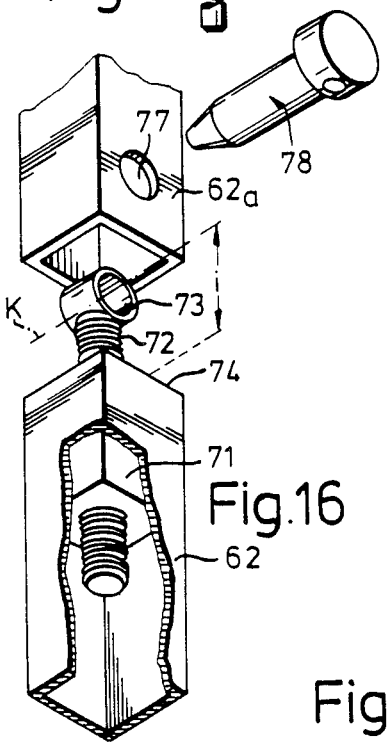
Fig.16
Fig.19
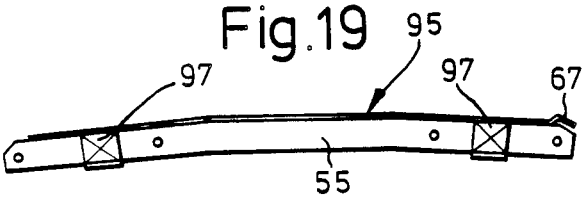
Fig.20
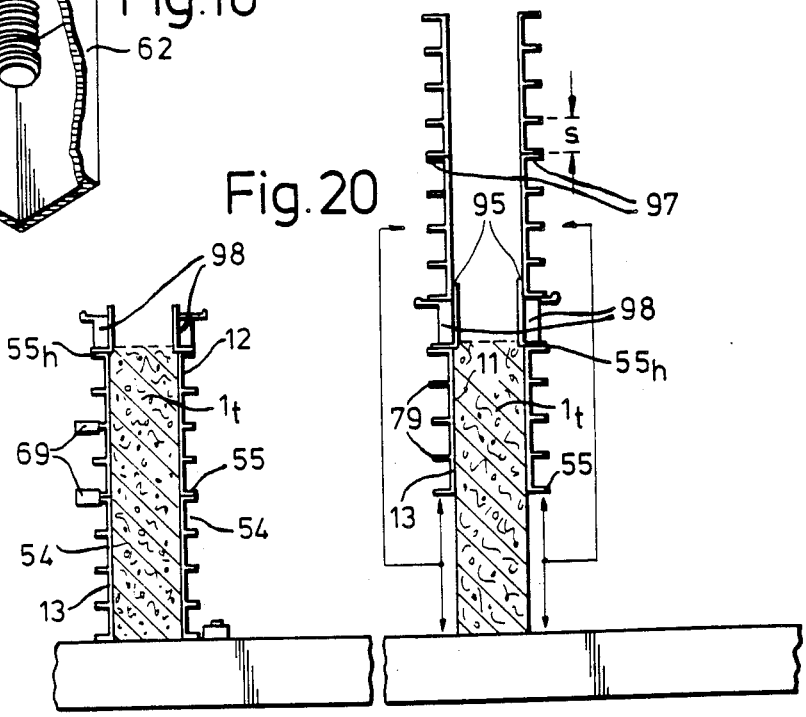

SHEATHING FOR POURING A CONTAINER FABRICATED FROM CONCRETE

The present invention relates to sheathing, in particular for containers that are either cylindrical or polygonal in cross section, this sheathing consisting of several sheathing panels that are installed adjacent to each other with vertical butt joints, and which when in use form a curved or polygonal sheathing surface, and are stiffened on the other, outside, surface by means of horizontal profile members, and adjusters acting on these profiles.

Sheathing of this kind which is used for round containers is described in Swiss Patent No. 574 553. This sheathing is based on sheathing panels that abutt on their angular and curved long edges and which are locked into position by means of wedges, said wedges engaging in slotted plates that are installed one above the other in the two sheathing panels and which optionally pass through a double holed connecter plate. However, on the one hand, such sheathing can only be used for a limited number of container sizes and, which is of great importance, cannot prevent the liquid concrete from escaping in the area of the butt joints. A framework, consisting of crossed over rods, is provided as an adjusting element.

In view of the foregoing, the present inventor has undertaken to so improve a sheathing of the type described above that, on the one hand, it is simple to assemble, and, on the other hand, offers adequate sealing. It should be easy to adjust the sheathing panels relative to each other and to put them under tension. Furthermore, it should also be possible to connect a deck sheathing in a problem free manner, this permitting a single pouring process for both the container walls and the container top.

This problem has been solved in that the sheathing panel has on one long edge an edge strip of a low-elasticity material that passes from the plane of the panel, preferably through an offset, this edge strip being sprung against the sheathing surface of the adjacent sheathing panel when this is in position, at least one tensioning device that acts on the two adjacent sheathing panels being arranged in the area of the long edge as an adjuster.

It is preferred that the tensioning device has at least two arms these being interconnected and articulated on each other which in each instance are articulated towards their ends to one of the sheathing panels, their point of articulation to be determined so as to be adjustable at a distance to the sheathing panels that are hinged to each other, this being done by means of a support, preferably an adjuster screw, that passes between the arms, and the length of which can be altered relative to the point of articulation. Thanks to this each pair of sheathing panels is supported at three points in the area of the vertical lapp joint, namely, on the one hand, at the free end of the adjuster screw and, on the other hand, on both sides of the joint at the hinge bolt of the arms. Thus the angle between adjacent sheathing panels can be changed by a simple adjustment of the screw this permitting, above all, a selectable tension in the sheathing panels in readiness for the pouring process.

According to a further feature of the present invention at least one of the arms of the tensioning device consists of a pair of plates the free end of the two plates being arranged on different sides of a longitudinal rib, an angle edge, or the like of one of the sheathing panels and being connected with that longitudinal rib or the like by means of a hinge pin. The use of pairs of plates as arms makes a simple construction possible that holds the two longitudinal ribs, that are aligned with each other, of adjacent sheathing panels or on their horizontal angle edges in each instance a pair of such angle edges. Thus, it is very simple to install the spreader.

It has been found to be expedient that the longitudinal ribs, angle edges, or the like of the two adjacent sheathing panels, that are more or less aligned with each other, be connected by means of a hinge pin or the like that passes through them and in each instance, at a distance therefrom, be provided with a drilled hole to accommodate a further hinge pin. The latter connects the pair of plates with the sheathing panel or with the longitudinal ribs of such panels or with a pair of angle edges. Furthermore, it has also been found to be expedient to provide the drilled hole of the individual longitudinal ribs with a sleeve for the hinge pin, the height of which is approximately that of the distance between the plates that go to make up a pair of plates; this height is double the height of each angle edge of the sheathing since the pair of plates will either contact two adjacent angle edges or, when fitted with the sleeve, a longitudinal rib.

It is also relevant to the present invention that the support with a threaded portion passes within a threaded hole of a bearing body of the tensioning device as well as within an angle to a pair of plates secured to a bearing device, whereas the other pair of plates is articulated.

The point of articulation itself is determined by at least one hinge stud that is secured to a bearer body. According to a further feature of the invention the latter accommodates the adjuster screw within a screw hole which consequently forms one unit with the tensioning device.

It has been found to be particularly expedient that the free end of the adjuster screw contacts the sheathing outside a construction axis—which passes for its part horizontally through the centre point of the adjuster screw cross section—in order that no load is imposed on its point of articulation which would eliminate the effect of the three point support. A stop lug acts as an aid to orientation in this respect and thanks to this the free screw end can be positioned rapidly; preferably this stop lug protrudes beyond the upper or lower surface of the longitudinal rib in order to simplify the installation of the aligned longitudinal ribs of the adjacent panel.

Because of the simply constructed tensioning system according to the present invention it is possible to tension all of the lapp joints of the adjacent sheathing panels so that any free play between them is eliminated. This tensioning prevents the bulges that frequently occur when the concrete is being poured.

Within the framework of the present invention, the edge strips can subtend an angle that is preferably approximately 20° with the plane of its sheathing panel when this is in an unloaded state; it is because of this that this tensioning takes place in the adjacent sheathing panel as a result of elastic deformation.

According to a further feature of the present invention the edge strip is either installed on the sheathing panel as a separate component or, as is preferred, forms one piece with the panel. In the case of sheathing panels consisting of a frame and a filling panel the edge strip is configured as part of the frame side.

In the case of the inner sheathing wall the angle between the plane of the panel and the edge strip is open to the outer side of the resulting concrete wall; in the case of the outer sheathing wall the corresponding features are in each instance to be viewed in the opposite direction.

A further mention of generating tension is seen in a bar structure that has a girth rod at a distance from the sheathing panel and this is connected to the profile by at least two rods. It is preferred that the latter be configured as a channel section having an opening that faces the sheathing panel, in which opening a common shoe of two of the framework rods that run from the junction points between the girth rod and the rod is inserted.

Because of at least one wedge, which according to the present invention is provided between the sheathing panel and the shoe or the framework rod any existing free play that is present during the pinning process can be eliminated. In the same manner, any lack of circular symmetry across the diameter of the container can be adjusted out and compensated for by this wedge.

The girth rod can be of adjustable length so as to adjust the sheathing. Hcwever, it has been shown to be particularly effective to provide a spindle as an adjusting element between two girth rods that abutt at their face ends, this spindle altering the distance between these rods.

According to the present invention a threaded bolt is used as a spindle element or adjuster; this is supported at one end in a threaded portion of the girth rod and at the other end is provided with a sleeve head that is transverse to the direction of the screw, the latter having an associated drilling in the other girth rod for a common pin. In addition, only one of the two adjacent girth rods need be fitted with a rod in the area of the adjuster.

The deck sheathing contains beams that are familiar in and of themselves and these beams protrude at approximately right angles from the inner wall of the sheathing and according to the present invention are supported on these on brackets by means of pins, in which connection in order to adjust the tension between the bracket and the deck sheathing horizontal wedges are inserted.

According to a further feature of the invention the deck sheathing is connected to the outer wall of the sheathing by means of a variable length mounting if the deck sheathing is done away with. The length of the mounting can be adjusted by means of a spindle; this is surrounded by two tubes that can telescope one within the other of which one provides a thrust support for the outer sheathing wall. On the outside, this is laid against the thrust bearing and then a thrust block is swung against the outer surface of the outer sheathing wall—in the case of a cylindrical sheathing, this is a radial collar.

Of particular importance for the present invention is the use of an intermediate panel.

The task undertaken by the inventor is solved in an impressive manner by those features that have been described and by those that can be derived from the claims and by this means he has achieved the fact that even large containers can be poured monolithically.

An important advantage in this as compared to other sheathing systems is the universal adjustability of, for example, approximately 5.00 meters internal diameter to an unrestricted upwards dimension, which is provided under the terms of the present invention; the sheathing which forms the present state of the art are restricted to an area from, for example, 6–12 meters or from 8–16 meters. The elements of the sheathing described in the present invention are universally exchangeable and permit both transportation and use which is essentially more economical.

A further economic advantage is that the walls and decks can be poured together, this being impossible in this manner when using other systems. Considerable savings in concrete, particularly with reference to working time and construction time will result from this. Thus pouring the concrete for the deck and the walls together and the direct sheathing will mean a considerable saving in time. The sheathing (wall) can be reused immediately regardless of whether it is used for a container with a deck or whether it is used for an open container.

The tensioning device makes it possible to carry out a pre- and post-tensioning of the sheathing individually at all points of the frame that is provided for this purpose and thus provides for exceptional adaptability.

Figure 2:
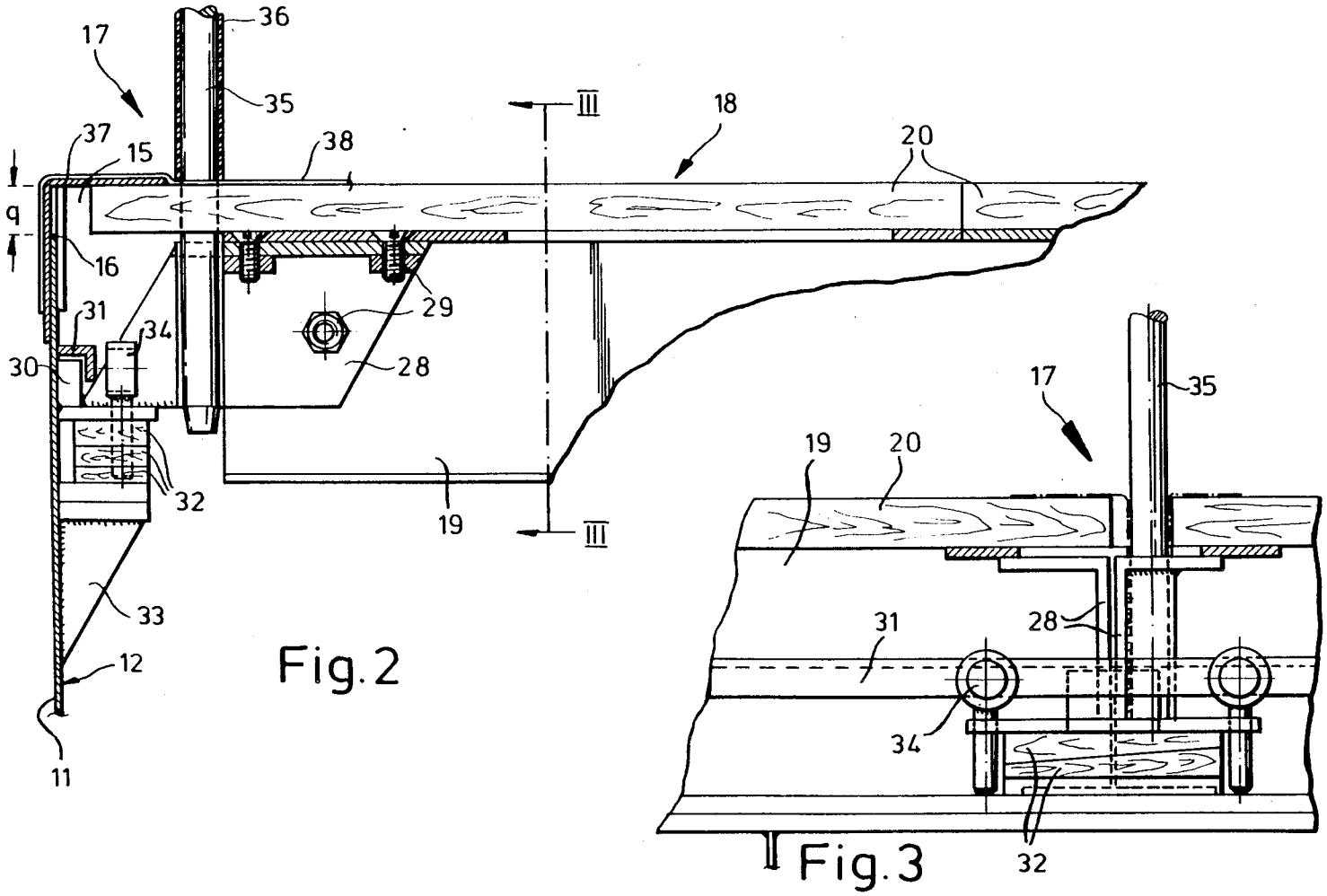
Figure 7:
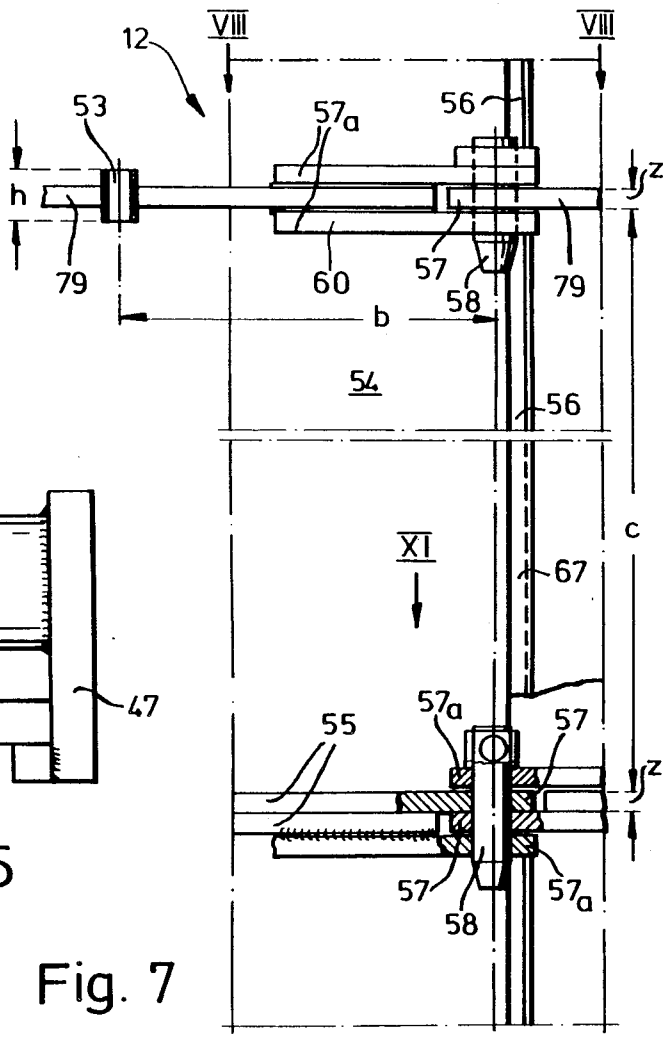
Figure 5:
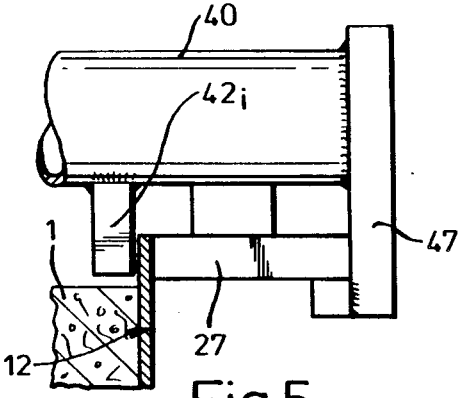
Figure 4:
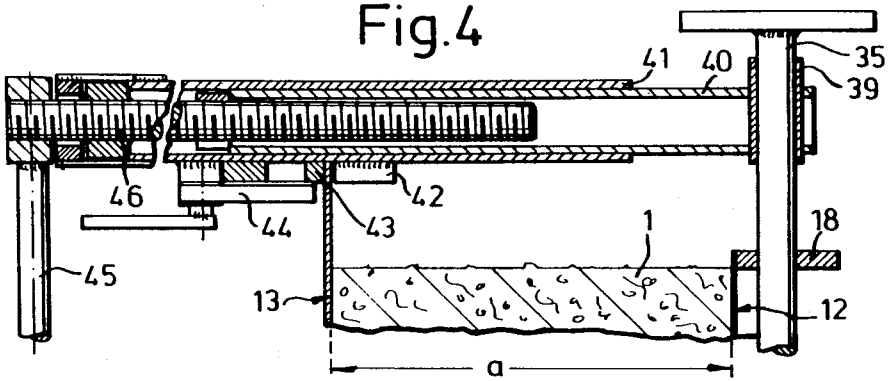
Figure 6:
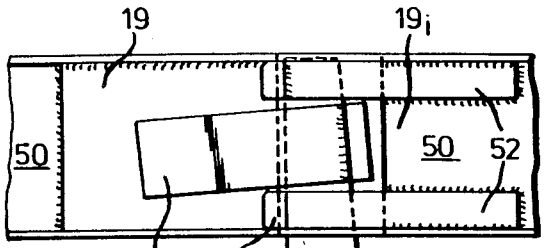
Figures 8, 9, 10:
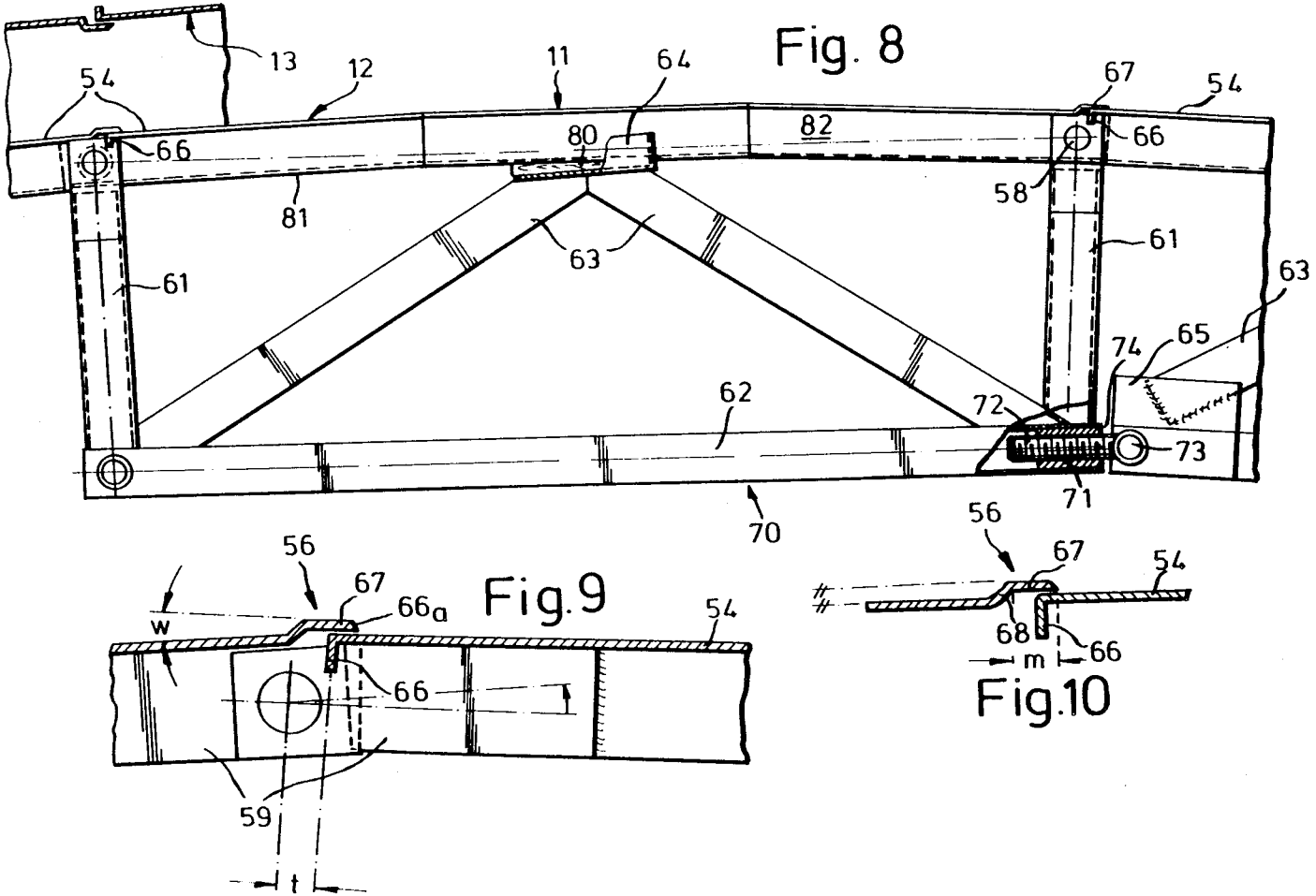

Further advantages, features and details of the present invention are set out in the following description of a preferred exemplary version which is explained on the basis of the drawings appended hereto. These drawings are as follows:

FIG. 1: a partial longitudinal section through a sheathing structure for a cylindrical concrete wall;

FIG. 2: an enlarged detail from FIG. 1 marked therein as area II;

FIG. 3: a section through FIG. 2 on the line III—III;

FIG. 4: a further enlarged detail from FIG. 1;

FIG. 5: a version of a detail modified in comparison to FIG. 4;

FIG. 6: a section according to area VI enlarged in comparison to FIG. 1;

FIG. 7: a side elevation of a sheathing wall, enlarged in comparison to FIG. 1;

FIG. 8: an enlarged cross section through FIG. 7, approximately on the line VIII—VIII;

FIG. 9: an enlarged detail from FIG. 8;

FIG. 10: the details of FIG. 9 shown in another position;

FIG. 11: a tensioning device for the inner sheathing on the angle edges in plan view of the latter as indicated by the arrow XI in FIG. 7;

FIG. 12: a front view of the tensioning device in FIG. 11;

FIG. 13: an oblique view of detail from FIG. 11;

FIG. 14: a tensioning device on a longitudinal rib;

FIG. 15: a small-scale reproduction of a tensioning device on an outer sheathing wall as in FIG. 11;

FIG. 16: an oblique view of a portion of FIG. 8;

FIG. 17: a schematic representation of an additional tool used for the part shown in FIG. 16;

FIG. 18: a front view of an intermediate panel;

FIG. 19: a plan view as per FIG. 18;

FIG. 20: a cross section through a concrete wall during the production process.

A sheathing or forming framework 10 for a cylindrical concrete body 1 surrounds an inner sheathing wall 12 that is arranged and centred about a centre axis A, and also includes an outer sheathing wall 13 that is at a distance a that amounts for example to 20 centimeters with in each case sheathing or forming surfaces 11 that face each other, against which the concrete body 1 lies. A sheathing tube 14 for a poured centre column 2 can be seen parallel to the sheathing walls 12, 13, in the vicinity of the axis.

On the upper edge 16 of the inner sheathing wall 12 a deck sheathing 18 is connected by means of a connecter 17, this consisting of radial beams 19 and sheathing panels 20. An inner radial beam $19_i$ has an end piece $19_e$ that is inclined downwards towards the axis, this being for a central dome not shown herein.

The deck sheathing 18 rests on aluminum I-sections 21 which in their turn are supported by telescopic jack posts 22 and 23. Between the telescopic jack posts 22 that are closest to the axis and the sheathing tube 14 there is a staging 25 that is held in place by means of snap fasteners 24. A further staging $25_a$ with oblique supports 26 protrudes outwards from the inner sheathing wall 12.

The connecter 17 includes two channel profiles 28 that lie adjacent to each other and these are either bolted or welded with a strut and a flange to the radial beams 19. Angle profiles 30 that are welded to the ring profiles 28 engage behind angle pieces 31 of the inner sheathing wall 12 and are supported with wedges 32 on a bracket 33 of the inner sheathing wall 12.

The inner sheathing wall 12 can be released from the tension that normally occurs by loosening the wedges 32 and subsequently removed. An opening mechanism, not shown herein, has to release the inner sheathing wall 12 from peripheral pressure to which end, for example, one of the sheathing panels 54 of the inner sheathing wall 12 can be unscrewed so as to loosen it.

Rotating pins 34 serve to hold each wedge 32 and to maintain them at the proper height. A rotating pin used to connect the outer sheathing wall 13 is numbered 35 and its plastic sleeve is numbered 36.

The edge forms a turned down angle 37 that is adjacent to the inner sheathing wall 12 at the level of the deck sheathing 18, and this is covered by a foil or film 38 and also covers the gap 15 between the polygon formed by the inner sheathing wall 12 and the deck sheathing 18. It also permits the upper area of the inner sheathing wall 12 (panel, angle piece 31 and sheet iron) to move upwards by a dimension q (FIG. 2) when the sheathing is being removed.

A sleeve 39 with a projecting radial tube 40 surrounds the rotating bolt 35 and a counter tube 41 encloses this radial tube 40 so as to permit it to slide. This counter tube 41 is provided with a stop 42 for the outer sheathing wall 13 and a radial collar extends outwards from this. There is a rotating strut 44 secured beneath the counter tube. The two tubes 40, 41 together with the spindle 46 are adjustable by means of a crank 45 and make it possible to change the dimension a.

According to FIG. 5 in another exemplary version a claw plate 47 is welded to the radial tube 40 and this holds the inner sheathing 12 close to a stop $42_i$ with a pressure piece 27.

Joints 48 between the radial beams 19, $19_i$ that are pressed from aluminum are connected by means of vertical wedges 49. To this end and in each instance pairs of plates 51, 52 are welded to the faces of the beam struts 50 and these are then spread apart in the axis in the beam by the wedge 49 if a pair of plates 51 of a radial beam 19 is arranged between the pair of plates 52 of the other radial beam $19_i$.

In a version that is not shown herein the radial beams 19, $19_i$ butt against one another with head plates that are held together by means of a bolt/wedge combination.

The inner sheathing wall 12 consists of sheathing panels 54 that lie next to each other along horizontal angle edge 55 so as to form vertical lapp joints 56. The angle edges 55 overlap each other at the collar edges 57 as well as by means of welded connecter tabs 57*a* and the pins 58 pass through these.

In FIG. 7 the individual longitudinal ribs 79 of the sheathing panels 54 pass above a pair of angle edges 55 that are in each instance 10 mm high—parallel to these at a distance c of 500 mm; these longitudinal ribs 79 are also connected by means of pins 58 through a pair of connecter tabs 57*a* that are welded to one side. The longitudinal rib 79 that has the latter is penetrated by a sleeve 53 at a distance b from the pin axis and the height h of this sleeve is double the height Z of the angle edge 55.

As is shown particularly in FIG. 8 rods 61 are connected to the u sections or flat sections 59; in the case of cylindrical sheathing these are radial. These rods 61 are connected to the girth rods 62 and support the framing rods 63. A shoe 64 on the latter rests against the u profiles 59 and can accommodate the wedges 80; by this means it is possible to generate tension at the u profile 59 and also eliminate the free play that is left in the sheathing during assembly. It is also possible to use this wedge 80 to correct any irregularities in the diameter of the sheathing. This wedge is driven in between the base surface 81 of the u profile 59, that is secured with its arm 82 to the sheathing panel 64, on the one hand, and the shoe 64 which is also of u-shaped cross-section.

Not shown is an exemplary version in which the sheathing panel 54 that consists of a frame and planking that covers this field, for example of wood, sheet metal or the like, the edge strip 67 with its offset 68 being joined to one edge of the frame in the manner described the frame edge that is parallel thereto being provided with the angle edge 66. It is preferred the frame be of cast aluminum or of welded aluminum construction and thus be very light and that planking be easy to replace.

According to FIG. 9 one of the two sheathing panels 54 stops in the area of the vertical lapp joint 56 with an edge 66*a*, that is overlapped by an offset edge strip 67 with an offset 68 of the other sheathing panel 54. The edge strip 57 is inclined towards the plane of the sheathing panel 54 at an angle w to this so that when the adjacent sheathing panel 54 is more or less aligned there will be a tension generated which seals the lapp joint 56. The width m of the edge strips 67 also permits the angle edge 66 to be displaced by a dimension t relative to the offset 68.

The rod framework or tension frame 70 that consists of the rods 61, 62, and 63 makes it possible to adjust the amount of curvature of the sheathing panel 54 to which end a screw connection is helpful between the adjacent girth rods 62, $62_a$ (FIG. 8). This consists of a screw bolt 72 and a sleeve head 73 that rests in a threaded nut 71 of the girth rod 62. The distance between the sleeve head axis and the face 74 of the rod can be adjusted by means of a bar 75 that is shown in FIG. 17; the length n of the neck 76 of this rod determines the dimension of the collar and through this the final distance of the girth rod 62, $62_a$ from each other. The other girth rod $62_a$ is slid over the sleeve head 73 until the drilled hole 77 of the girth rod $62_a$ is aligned with the sleeve head 73. A pin 78 is then inserted so as to join them together.

The preferred tensioning device for the sheathing panels 54 is shown in FIGS. 11 to 15; the tensioning device 69 makes it possible to establish the dimension of curvature of the sheathing panel 54 in a most simple manner. The tensioning device 69 engages on the pair of angle edges 55 shown in FIG. 7, the inner sheathing wall 12 of which is close to their pins 58. At a distance b, of, for example, 200 mm from the pins 58 there are on both sides of this holes 84 in the angle edges 55 and these accommodate the hinge pins $58_a$ of the tensioning device 69.

Each of the pins $58_a$ passes through a pair of plates 85, 86 of the tensioning device 69, apart from the angle edge 55. The left hand pair of plates 85 shown in FIGS. 11 and 12 is welded on both sides of a square block 87 to this; its height h determines the distance between the plates and an adjusting screw 88 passes through this. Its free end 89 rests against a longitudinal rib 79 beyond a construction axis B that is determined by pin 58 or its middle axis.

The block 87 and the pair of plates 85 form an arm of the tensioning device 69 the side of the block 87 that is parallel to the adjusting screw 88 together with the pair of plates 85 that is attached to this—and in consequence of this with the adjusting screw 88—forming a fixed angle y in plan view. The moveable other arm includes the second pair of plates 86 and hinge pieces 90 that are welded to this; the latter are in each instance connected to the other arm 85/87 by means of a stud 91 and secured in place by means of a split pin 92. In order to make it possible that—as described—the adjusting screw 88 passes outside the axis of construction B, the distances f, $f_1$ of the pins 91 to the two pins $58_a$ are different. In addition a stop lug 93 is provided on the left longitudinal rib 79 which as is shown in FIG. 13 is welded to the lower angle edge 55 and protrudes above this as a stop for the upper angle edge $55_h$. In addition, the stop lug 93 assists the positioning of the free end 89 of the adjuster screw 88.

If the adjusting screw 88 is now moved the distance k between the longitudinal rib 79 and the block 87 changes and this causes a change in the angle w. Using the movement of this screw it is possible to place the sheathing under tension before the concrete is poured and this prevents any type of bulging that is caused by the pressure of the liquid concrete.

FIG. 14 shows the left-hand arm of the tensioning device 69, which is here secured to the longitudinal rib 79. It can be seen that the sleeve 53 permits the maintenance of the distance h between the plates and in addition accommodates the pin $58_a$.

FIG. 15 shows a tensioning device 69 on the outer sheathing wall 13. After the first sheathing process and the pouring of the footings $1_f$ the lower sheathing panels 54 are removed from the inside and the outside and installed on the contact base 97 of the next outer sheathing wall 13 that is located above. The panels are installed without any tension. After installation the inner sheathing wall 12 is attached, when distance pieces are used above.

FIG. 20 shows the installation process, on the left-hand side is the sheathing of a wall footing $1_f$ that is on a foundation 3; there are on each side two sheathing panels 54 one above the other and in each instance four profiles 55, 79 the distance s between which amounts to 25 cm and of which each second profile 55, 79 is provided with a pretensioner or tension device 69 (this being shown in part).

There is in each instance an intermediate panel 95 that is installed on the two upper angle edges $55_h$ this abutts against the upper surface 11 of the form and is shown in FIGS. 18 and 19.

At a distance g from the upper edge 96 of the panel there is an installation plane E that is determined from the support column 97 on the vertical profile 98.

The two intermediate plates 95 are installed in a conventional manner by means of pins 58 during the first sheathing process (FIG. 20, left) but their intermediate space is not emptied.

I claim:

1. A sheathing for use as a covering on a polygonal container having a plurality of adjustable support members for supporting said sheathing wherein the sheathing comprises at least two adjacent panels having a vertical joint therebetween, the improvement which comprises one edge of one of said at least two adjacent panels forming said joint has an offset vertical edge with a stepped configuration which overlies an adjacent edge of the other of said at least two adjacent panels, at least one horizontal longitudinal rib on an inner side of each of said at least two adjacent panels, said longitudinal rib of one adjacent panel being pivotably connected at a first pivot point with said longitudinal rib on the other adjacent panel in the vicinity of said vertical joint, at least two plates each having one portion pivotably connected to each other at a second pivot point and another portion pivotably connected to a respective one of the longitudinal ribs of said at least two adjacent panels at a third pivot point spaced from said first pivot point, and adjustable tensioning means for adjusting the distance between said first pivot point and said second pivot point for articulating said adjacent panels.

2. A sheathing according to claim 1 wherein said tensioning means includes a support for adjustingly supporting said second pivot point.

3. A sheathing according to claim 2 including a pin passing through the ribs for connecting the longitudinal ribs of the two adjacent panels to each other at said first pivot point at a distance (b) from a hole adapted to accommodate a further pin at one of said third pivot points.

4. A sheathing according to claim 3 wherein the hole in the longitudinal rib accommodates a sleeve that surrounds the further pin the height of which (h) corresponds approximately to the distance between the plates.

5. A sheathing according to claim 4 wherein the support is provided with a threaded portion which passes into a threaded hole of a carrier of the tensioning means.

6. A sheathing according to claim 5 wherein the support is an adjusting screw, one free end of which is mounted off center to the pin at said first pivot point.

7. A sheathing according to claim 6 wherein the second pivot point comprises a stud which is secured to the carried body.

8. A sheathing according to claim 7 wherein a movable pair of plates is connected through welded articulation tabs with the stud.

9. A sheathing according to claim 8 wherein on the longitudinal rib next to the first pivot point is provided at least one stop lug which protrudes beyond the plane of the longitudinal rib parallel to the hinge pin.

10. A sheathing according to claim 9 wherein the offset edge forms with the plane of its panel an angel (w) that is approximately 20°.

11. A sheathing according to claim 10 wherein the offset edge edge is formed from the sheathing panel.

12. A sheathing according to claim 11 wherein a sheathing panel is provided with a frame provided with the offset edge.

13. A sheathing according to claim 12 wherein a long edge of the adjacent panel is configured as an angle and abuts the offset edge.

14. A sheathing according to claim 13 wherein the sheathing comprises a plurality of panels forming an inner sheathing wall, a plurality of panels forming an outer sheathing wall spaced from the inner wall, and deck sheathing supported by the inner wall, said inner wall having brackets at an upper end thereof and downwardly extending angle profiles above the brackets, said deck sheathing including support beams extending at approximately a right angle from the inner wall, said beams having upwardly extending angle profiles secured thereto, said beam angle profiles being secured behind the inner wall angle profiles by wedges provided between the brackets and the support beams.

15. A sheathing according to claim 14 wherein the deck sheathing is connecting to the outer sheathing wall through a holder, the length of which can be changed and whose length is adjusted by means of a spindle.

16. A sheathing according to claim 15 wherein the spindle is surrounded by two tubes that can slide one within the other wherein one of said tubes is provided with a stop for the outer sheathing wall.

17. A sheathing according to claim 16 wherein a stop for the sheathing surface of the outer sheathing wall is secured to one tube.

18. A sheathing according to claim 17 wherein an intermediate panel an upper edge of an upper sheathing panel, lies against the upper sheathing panel and on the outside at a distance (g) from the upper edge is provided withan installation plane (E) for a sheathing panel which lies above the installation plane to the intermediate panel.

19. A sheathing according to claim 14 wherein the wedges are secured in place by pins extending through the support beams adjacent the wedges.

* * * * *

UNITED STATES PATENT AND TRADEMARK OFFICE

CERTIFICATE OF CORRECTION

PATENT NO. : 4,705,258

DATED : November 10, 1987

INVENTOR(S) : Peter Frei

It is certified that error appears in the above-identified patent and that said Letters Patent is hereby corrected as shown below:

Column 1, line 48, after "arms" insert --,--.

Column 8, claim 7, line 53, change "carried" to --carrier--.

Column 8, claim 10, line 62, change "angel" to --angle--.

Column 8, claim 11, line 65, delete "edge", second occurrence.

Column 10, claim 18, line 11, after "panel" insert --is installed on--.

Column 10, claim 18, line 14, change "withan" to --with an--.

Signed and Sealed this

Tenth Day of May, 1988

*Attest:*

*Attesting Officer*

DONALD J. QUIGG

*Commissioner of Patents and Trademarks*